US008455746B2

(12) United States Patent
Johnston et al.

(10) Patent No.: US 8,455,746 B2
(45) Date of Patent: Jun. 4, 2013

(54) BEATER BRACKET AND VARIABLE DRIVE LEVER SYSTEM WITH VARIABLE PIVOT POINT SPRING ROTOR FOR BASS DRUM FOOT PEDALS

(75) Inventors: Darrell Johnston, Harbor City, CA (US); Charles Blashaw, Rancho Palos Verdes, CA (US)

(73) Assignee: Axis Percussion, Inc., Carson, CA (US)

( * ) Notice: Subject to any disclaimer, the term of this patent is extended or adjusted under 35 U.S.C. 154(b) by 20 days.

(21) Appl. No.: 13/314,790

(22) Filed: Dec. 8, 2011

(65) Prior Publication Data

US 2012/0144976 A1 Jun. 14, 2012

Related U.S. Application Data

(60) Provisional application No. 61/420,851, filed on Dec. 8, 2010.

(51) Int. Cl.
*G10D 13/02* (2006.01)

(52) U.S. Cl.
USPC ..... 84/422.1; 984/152

(58) Field of Classification Search
USPC ..... 84/422.1; 984/182
See application file for complete search history.

(56) References Cited

U.S. PATENT DOCUMENTS 1,564,839 A * 12/1925 Evans ..... 84/422.1
2,027,869 A * 1/1936 La Londe ..... 84/422.1
2,132,211 A * 10/1938 Hueckstead ..... 84/422.1
2,446,508 A * 8/1948 Crowell ..... 84/422.1
3,030,847 A * 4/1962 Thompson ..... 84/422.1
4,134,325 A * 1/1979 Loftus ..... 84/422.1
4,782,733 A * 11/1988 Herring ..... 84/422.1
4,819,536 A 4/1989 Lombardi
4,829,874 A 5/1989 Hoshino
4,873,910 A * 10/1989 Kurosaki ..... 84/422.1
4,905,565 A 3/1990 Hoshino
4,945,802 A * 8/1990 Ruprecht ..... 84/422.1
4,955,277 A 9/1990 Carlson
4,958,549 A * 9/1990 Vukovic ..... 84/422.1
5,090,289 A * 2/1992 Holcomb ..... 84/422.1
5,105,706 A 4/1992 Lombardi
5,301,592 A * 4/1994 Johnston ..... 84/422.1
5,509,342 A * 4/1996 Augsburger ..... 84/422.1
D390,253 S * 2/1998 Bacco ..... D17/22
5,936,177 A * 8/1999 Shigenaga ..... 84/422.1
6,063,993 A * 5/2000 Hoshino ..... 84/422.1
6,166,312 A * 12/2000 Brewster et al. ..... 84/422.1
6,239,342 B1 * 5/2001 Chang ..... 84/422.1
7,197,957 B2 * 4/2007 Gatzen ..... 74/560
7,449,626 B2 * 11/2008 Chen ..... 84/422.1

(Continued)

OTHER PUBLICATIONS

Rick Van Horn, "Axis and Axis-E Pedals", Modern Drummer, Feb. 1991, pp. 48-49.

(Continued)

*Primary Examiner* — David Warren
*Assistant Examiner* — Robert W Horn
(74) *Attorney, Agent, or Firm* — Risso & Associates

(57) ABSTRACT

Described is a bass drum foot pedal having a variable drive lever linkage with variable arc ratios connecting the foot pedal to a beater bracket. The beater bracket is formed with a mounting surface that tips a beater shaft forward to create a forward beater angle that maximizes the beater impact against a bass drum.

6 Claims, 9 Drawing Sheets

U.S. PATENT DOCUMENTS

| | | | | |
|---|---|---|---|---|
| 7,550,663 | B2 * | 6/2009 | Lin | 84/422.1 |
| 7,579,539 | B2 * | 8/2009 | Chen | 84/422.1 |
| 7,956,268 | B1 * | 6/2011 | Liao | 84/422.1 |
| 8,278,541 | B2 * | 10/2012 | Dorfman et al. | 84/422.1 |
| 2003/0005811 | A1 * | 1/2003 | Hsieh | 84/422.1 |
| 2003/0159563 | A1 * | 8/2003 | Shigenaga | 84/422.1 |
| 2005/0150354 | A1 * | 7/2005 | Paul et al. | 84/422.1 |
| 2012/0144976 | A1 * | 6/2012 | Johnston et al. | 84/422.1 |
| 2012/0198984 | A1 * | 8/2012 | Johnston | 84/422.1 |

OTHER PUBLICATIONS

U.S. Appl. No. 07/715,626, Non-Final Rejection, Jan. 24, 1992.
U.S. Appl. No. 07/715,626, Mail Non-Final Rejection, Jan. 30, 1992.
U.S. Appl. No. 07/715,626, Response after Non-Final Action, Mar. 30, 1992.
U.S. Appl. No. 17/715,626, Final Rejection, Jun. 12, 1992.
U.S. Appl. No. 07/715,626, Substitute Specification Fiied, Oct. 5, 1992.
U.S. Appl. No. 07/715,626, Amendment after Final Rejection, Dec. 24, 1992.
U.S. Appl. No. 07/715,626, Advisory Action (PTOL-303), Jan. 4, 1993.
U.S. Appl. No. 07/715,626, Examiner interview Summary Record (PTOL-413), Sep. 15, 1993.
U.S. Appl. No. 07/715,626, Drawing Preliminary Amendment, Jun. 3, 1992.
U.S. Appl. No. 07/715,626, Claim Preiirninani Amendment, Jun. 3, 1992.
U.S. Appl. No. 07/715,626, Drawing Preiiminary Amendment, Jun. 14, 1992.
U.S. Appl. No. 07/715,626, Claim Preliminary Amendment, Jun. 14, 1992.

* cited by examiner

100

BEATER BRACKET AND VARIABLE DRIVE LEVER SYSTEM WITH VARIABLE PIVOT POINT SPRING ROTOR FOR BASS DRUM FOOT PEDALS

PRIORITY CLAIM

This is a non-provisional application of U.S. Provisional Application No. 61/420,851, filed on Dec. 8, 2010, entitled, "A21 Beater Bracket and Variable Drive Lever System with Variable Pivot Point Spring Rotor for Bass Drum Foot Pedals."

BACKGROUND OF THE INVENTION (1) Field of Invention

This invention relates to foot pedals for bass drums and, more specifically, to a beater bracket that is designed to accelerate a beater into the bass drum with greater force and velocity.

(2) Description of Related Art

Foot pedals have long been used for striking bass drums, since the use of a foot pedal frees both of the drummer's hands for use with snare drums, cymbals or other devices. However, most prior art bass drum pedals have been constructed with a fixed drive action. This means that the drummer must vary the force with which the beater impacts the drum head by varying the force applied by the drummer's foot. Unfortunately, some drummers have a "heavier foot" than others and, hence, must constantly guard against causing the beater to strike the drum head too vigorously, while other drummers have a very "light foot" and, consequently, must exert conscious effort to effect a desired beater impact. Some attempts have been made to provide adjustable drive action. However, the adjustable drive action foot pedals of the prior art have been complex, expensive to produce and difficult to adjust and maintain.

U.S. Pat. No. 5,301,592 (hereinafter referred to as the '592 patent) was devised to address several of the deficiencies listed above. As shown in FIG. 1, the '592 patent shows a bass drum foot pedal 01 having a variable drive lever linkage 02 with variable arc ratios connecting the foot pedal 03 to the beater bracket 04. The '592 patent was a significant improvement over the prior art in that the variable drive lever linkage 02 is adjustable to vary the impact force and strike point of the beater 05.

While the '592 patent describes a very desirable product that provides for a wide range of adjustability of optimizing performance, the beater bracket 04, in of itself, does not optimize impact force. The beater bracket 04 includes a long axis 06 with a mounting surface 07 in parallel alignment with the long axis 07. A clamp means 08 is used to attach the shaft 09 of the beater 05 to the mounting surface 07 of the beater bracket 04. Because the mounting surface 07 is in parallel alignment with the long axis 07, the shaft 09 extends perpendicular to the exterior surface 07 and long axis 06. This configuration, in of itself, does not optimize the impact force of the beater 05.

Thus, a continuing need exists for a redesigned beater bracket that optimizes the impact force of a beater.

SUMMARY OF INVENTION

The present invention provides an improved bass drum pedal which has a variable drive action which is simple and economical to produce and which is readily adjustable to accommodate a wide variety of foot strengths. Importantly, the present invention includes a new beater bracket that is formed with a mounting surface that tips a beater shaft forward to create a forward beater angle that maximizes the beater impact against a bass drum.

The bass drum pedal includes a base and a foot pedal having one end pivotally secured to a front end of said base. A column is connected to said base adjacent to the opposite end of said base from said front end and extending longitudinally above said base. A beater bracket is pivotally mounted to said column and adjacent to the upper end of said column. A linkage means is included for linking said foot pedal to said beater bracket to actuate said beater bracket in response to a force applied to said foot pedal and adjustably coupled therebetween to permit selective positioning along said beater bracket. Bias means are included for biasing said beater bracket to said column and adjustably coupled therebetween to permit selective control of the force required for said foot pedal to move said beater bracket. The bias means includes a spring connected between said column and said beater bracket. A beater having a shaft is releasably secured in said beater bracket for striking a bass drum in response to said beater bracket being moved by said foot pedal.

The beater bracket includes a pivot end having a pivotal attachment means. An outer end is opposite the pivot end, with a long axis passing between the pivot end and the outer end. A mounting surface is formed on the beater bracket such that a mounting surface angle exists between the long axis and the mounting surface.

In one aspect, the mounting surface angle is between ten and forty degrees and, more desirably, is between nineteen and twenty three degrees.

In another aspect, the mounting surface angle is approximately twenty one degrees.

An attachment means is formed on the mounting surface to attach with a shaft of a beater, such that when a shaft of a beater is attached with the mounting surface, the shaft is tipped forward to form a forward beater angle that corresponds with the mounting surface angle. The attachment means is a shaft bore that extends through the beater bracket adjacent the outer end to releasably receive the shaft of a beater.

Finally, as can be appreciated by one in the art, the present invention also comprises a method for forming and using the invention described herein.

BRIEF DESCRIPTION OF THE DRAWINGS

The objects, features and advantages of the present invention will be apparent from the following detailed descriptions of the various aspects of the invention in conjunction with reference to the following drawings, where.

DETAILED DESCRIPTION

The following description is presented to enable one of ordinary skill in the art to make and use the invention and to incorporate it in the context of particular applications. Various modifications, as well as a variety of uses in different applications will be readily apparent to those skilled in the art, and the general principles defined herein may be applied to a wide range of embodiments. Thus, the present invention is not intended to be limited to the embodiments presented, but is to be accorded the widest scope consistent with the principles and novel features disclosed herein.

In the following detailed description, numerous specific details are set forth in order to provide a more thorough understanding of the present invention. However, it will be apparent to one skilled in the art that the present invention may be practiced without necessarily being limited to these specific details. In other instances, well-known structures and devices are shown in block diagram form, rather than in detail, in order to avoid obscuring the present invention.

The reader's attention is directed to all papers and documents which are filed concurrently with this specification and which are open to public inspection with this specification, and the contents of all such papers and documents are incorporated herein by reference. All the features disclosed in this specification, (including any accompanying claims, abstract, and drawings) may be replaced by alternative features serving the same, equivalent or similar purpose, unless expressly stated otherwise. Thus, unless expressly stated otherwise, each feature disclosed is only one example of a generic series of equivalent or similar features.

Furthermore, any element in a claim that does not explicitly state "means for" performing a specified function, or "step for" performing a specific function, is not to be interpreted as a "means" or "step" clause as specified in 35 U.S.C. Section 112, Paragraph 6. In particular, the use of "step of" or "act of" in the claims herein is not intended to invoke the provisions of 35 U.S.C. 112, Paragraph 6.

Please note, if used, the labels left, right, front, back, top, bottom, forward, reverse, clockwise and counter clockwise have been used for convenience purposes only and are not intended to imply any particular fixed direction. Instead, they are used to reflect relative locations and/or directions between various portions of an object.

Before describing the invention, it is important to note that the present invention is an improvement over U.S. Pat. No. 5,301,592 (hereinafter referred to as the '592 patent), which is incorporated by reference as though fully set forth herein.

Figure 1:
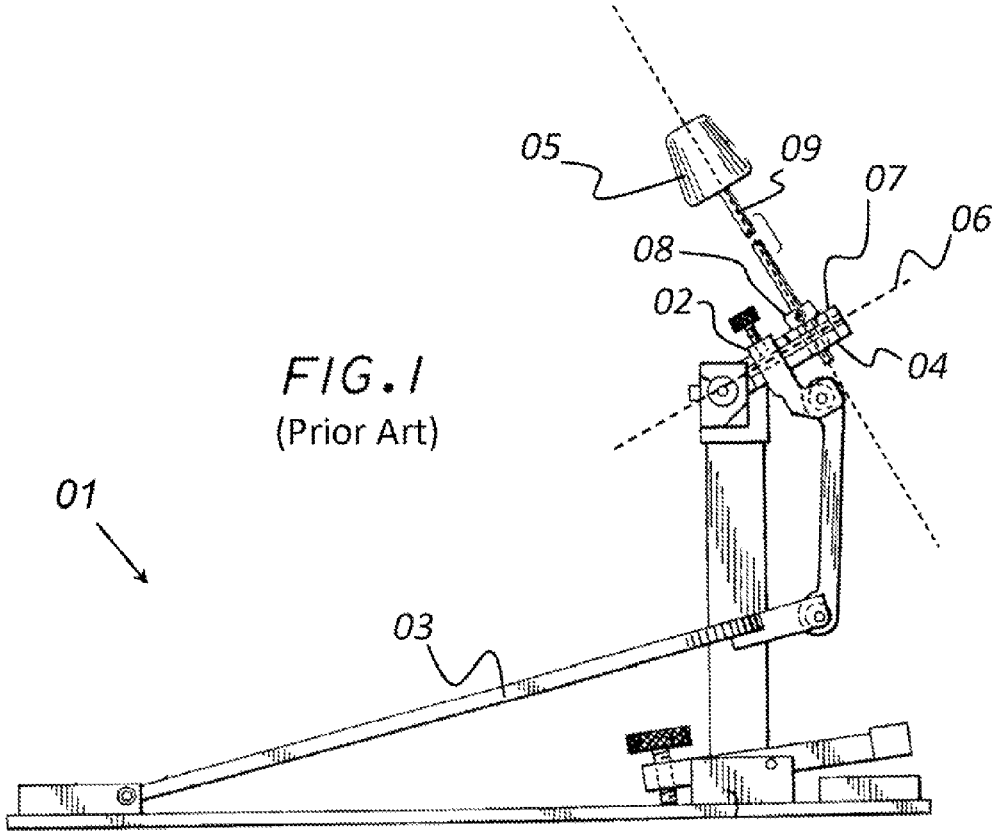
FIG. 1 (Prior Art)
FIG. 1 is a right, side-view illustration of a bass drum foot pedal of the prior art.
Figures 2, 3, 4:
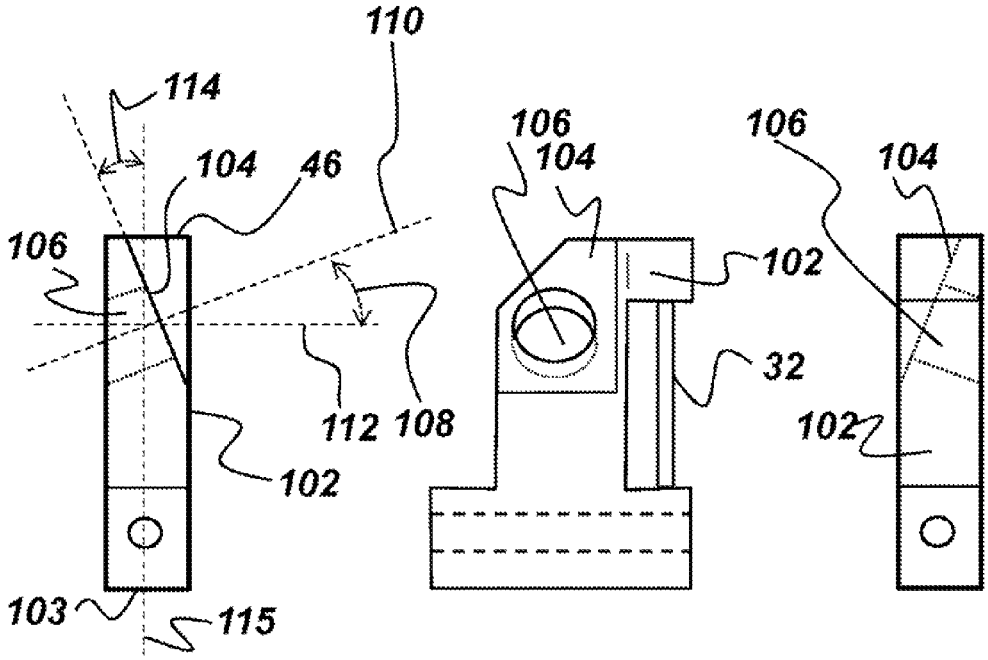
FIG. 2 is a left, side-view illustration of a beater bracket according to the present invention.
FIG. 3 is a top-view illustration of a beater bracket according to the present invention.
FIG. 4 is a right, side-view illustration of a beater bracket according to the present invention.
Figure 5:
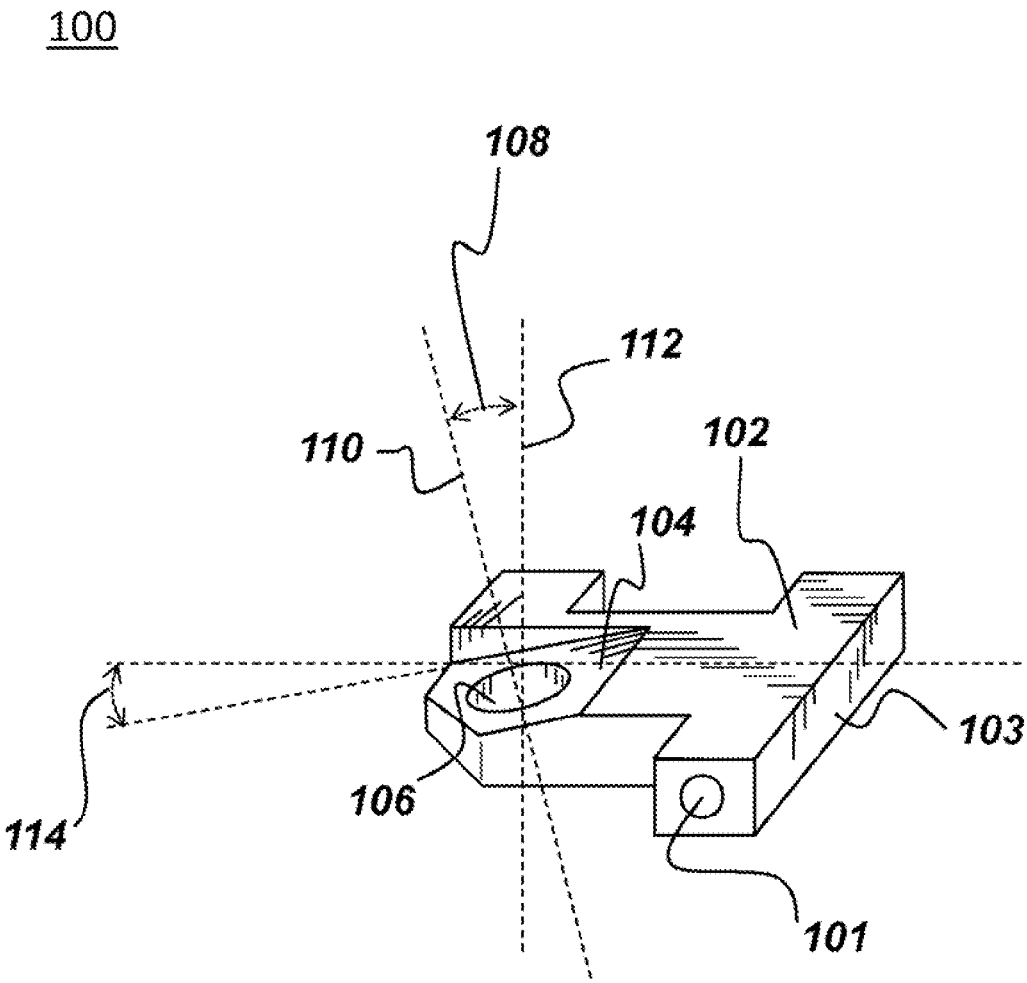
FIG. 5 is a perspective-view illustration of a beater bracket according to the present invention.

As shown in FIGS. 2 though 5, the present invention is directed to a beater bracket 100. More specifically, FIG. 2 is a left, side-view illustration of a beater bracket 100, while FIGS. 3, 4, and 5 depict top, right, and perspective-views, respectively. The beater bracket 100 is specifically designed to accelerate the beater into a bass drum with greater force and velocity than beater brackets of the prior art.

As shown in FIG. 2, the beater bracket 100 includes a top surface 102 and a mounting surface 104. The mounting surface 104 includes an attachment means 106 for attaching with a shaft of a beater. The attachment means 106 is any suitable mechanism, device, or configuration for attaching with a shaft of a beater. Desirably, the attachment means 106 is a shaft bore or hole that passes through the beater bracket 100. A unique aspect of the present invention is the angle at which the mounting surface 104 allows for attachment of a beater and its shaft. In other words, when a beater shaft is attached with mounting surface 104, the beater shaft passes through attachment means 106 (i.e., shaft bore) and uses a clamp means for affixing the beater shaft with the mounting surface 104. Once the beater shaft is attached with the mounting surface104, a forward beater angle 108 is formed.

The forward beater angle 108 causes the beater shaft (and beater) to rest at a forward position. In other words, when the beater shaft is attached with the mounting surface 104, the beater shaft protrudes from the mounting surface 104 along a bore axis 110 that is tipped forward (i.e., the forward beater angle 108) from a line 112 (i.e., orthogonal projection) that is perpendicular to the top surface 102. The forward beater angle 108 is any suitable angle that tips the beater shaft forward to maximize the beater impact against a bass drum. Desirably, the forward beater angle 108 is between ten and forty degrees and, more desirably, between fifteen and twenty five degrees. In another aspect, the forward beater angle 108 is desirably between nineteen and twenty three degrees and, more desirably, is approximately twenty one degrees.

The forward beater angle 108 is formed by the mounting surface angle 114. The mounting surface angle 114 is the angle by which the mounting surface 104 falls away from a plane aligned with the top surface 102 and passes through a long axis 115 of the beater bracket 100. The beater bracket 100 includes an outer end 46 and a pivot end 103, with the long axis 115 passing therebetween. Thus, the mounting surface angle 114 is the angle between the long axis 115 and the mounting surface 104. When the beater shaft is attached with the mounting surface 104, the forward beater angle 108 is formed. Thus, the mounting surface angle 114 is the same as the forward beater angle 108. Desirably, the mounting surface angle 114 is between ten and forty degrees and, more desirably, between fifteen and twenty five degrees. In another aspect, the mounting surface angle 114 is desirably between nineteen and twenty three degrees and, more desirably, is approximately twenty one degrees.

For further understanding, FIG. 5 provides a perspective-view of the beater bracket 100. As shown, the mounting surface 104 falls away from the top surface 102 at an angle that is equal to the mounting surface angle 114. Also shown is the shaft bore (attachment means 106) with a bore axis 110 that is tipped forward from a line 112 (orthogonal projection) that is perpendicular to the top surface 102, thereby forming the forward beater angle 108.

The beater bracket 100 includes a pivotal attachment means 101. The pivotal attachment means 101 is any suitable mechanism, device, or configuration that allows the beater bracket 100 to be pivotally attached with the base drum foot pedal. As a non-limiting example, the pivotal attachment means 101 is a hole or bore that passes through a pivot end 103 of the beater bracket 100.

It should be understood that the beater bracket 100 can be used with a variable drive lever system. For example and referring again to FIG. 3, the beater bracket 100 can include a rod 32 (not shown in FIGS. 2, 4, and 5) that allows for a slide member (shown as element 30 in FIG. 6) to be affixed with the beater bracket 100 in a desired position. Thus, through adjustment of the slide member along the rod 32 and the optimized angle of the mounting surface 104, the beater bracket 100 enhances the performance of the variable drive lever. The mounting surface angle of the beater bracket 100 maximizes the beater impact at any adjustment setting of the variable drive lever (i.e., slide member).

Figure 6:
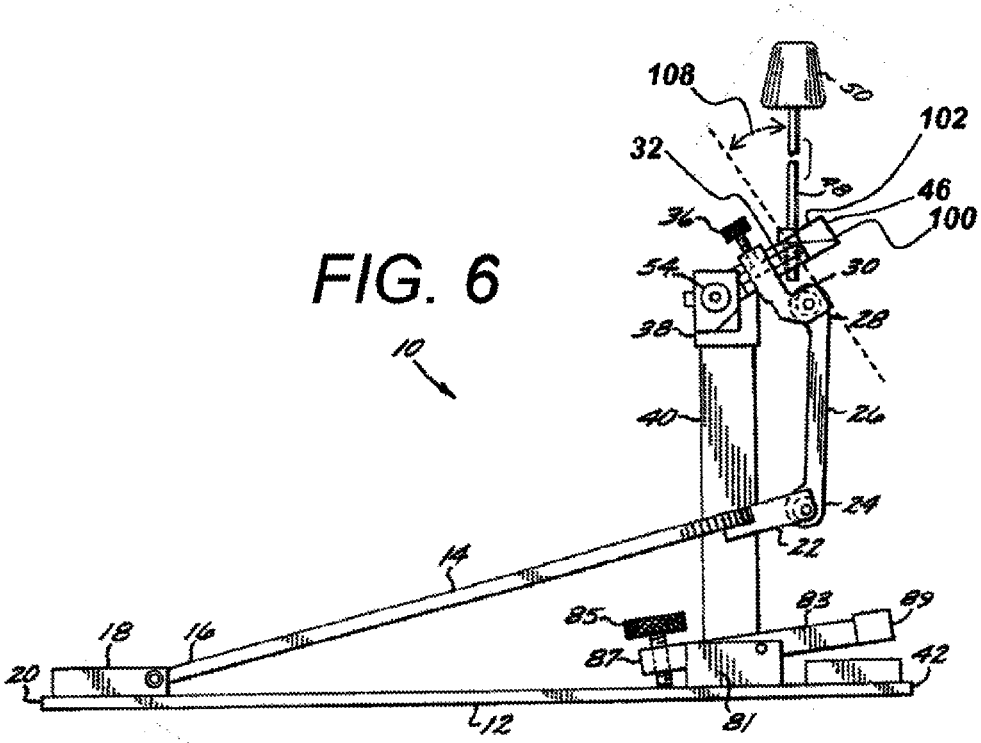
FIG. 6 is a right, side-view illustration of a bass drum foot pedal embodying the present invention.
Figure 7:
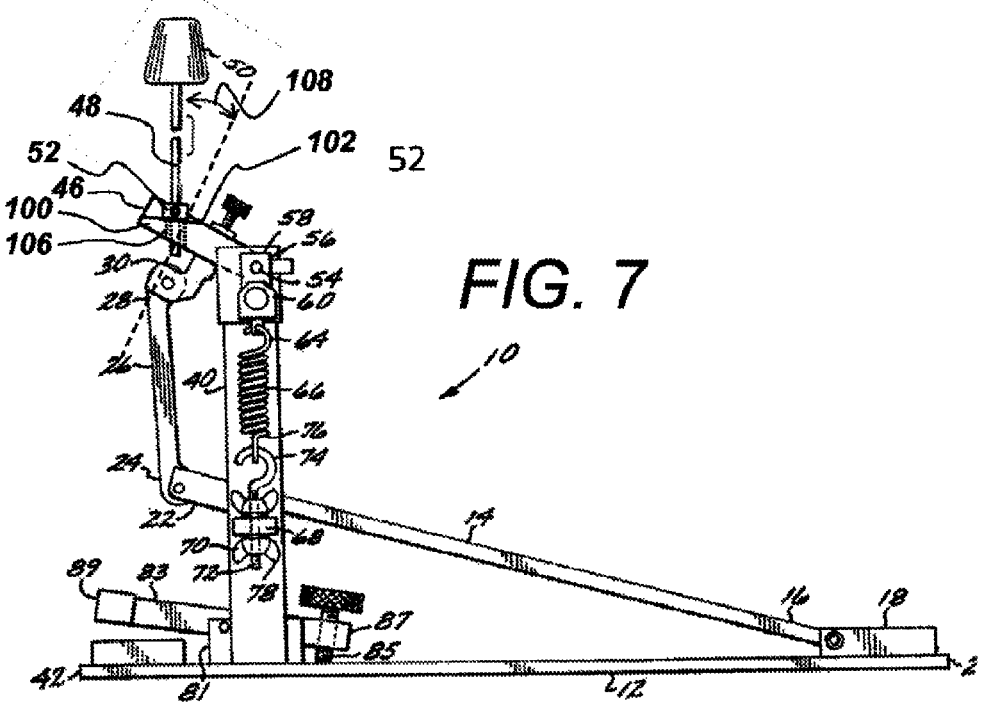
FIG. 7 is a left, side-view illustration of a bass drum foot pedal embodying the present invention.

For further understanding, FIGS. 6 and 7 illustrate right and left side-views, respectively, of a bass drum foot pedal 10 embodying the present invention. The bass drum foot pedal 10 includes a flat elongated base 12 with a foot pedal 14 having one end 16 pivotally secured to a block 18 located adjacent one end 20 of the base 12. The opposite end 22 of the foot pedal 14 is pivotally secured to the lower end 24 of a link member 26 whose upper end 28 is pivotally secured to the lower end of a slide member 30. The slide member 30 is movable along a rod 32 carried by the beater bracket 100 and may be secured in a desired position along the rod 32 by suitable means, such as thumbscrew 36 or a ¼-20 drum key screw. A drum key screw on the variable drive lever improves the ease of adjustment with the use of a drum key to tighten the slide member of the variable drive lever instead of tightening a thumb screw with fingers.

In this aspect, the beater bracket 100 is pivotally mounted adjacent the upper end 38 of a column 40 which is fixedly mounted adjacent the forward end 42 of the base 12 and extends vertically upward therefrom. The beater bracket 100 is formed with a shaft bore (i.e., attachment means) extending therethrough adjacent the outer end 46 of the beater bracket 100 to releasably receive the shaft 48 of a suitable beater 50. Clamp means 52 are mounted on the beater bracket 100 adjacent the shaft bore (i.e., attachment means 106) to releasably retain the shaft 48 of the beater 50 such that the shaft 48 resides at the forward beater angle 108.

The beater bracket 100 is pivotally mounted on the column 40 by a pivot arm 54 which extends through the upper end 38 of the column 40 and carries a first link member 56 on its opposite end 58 and a second link member 60 is pivotally connected between the lower end 62 of the first link member 56 and the upper end 64 of a spring 66. A flange 68 projects laterally from the column 40 and has an opening 70 extending therethrough to receive the shank 72 of a hook 74 which retains the lower end 76 of the spring 66. A thumbnut 78 serves to permit adjustment of the tension applied by hook 74 to the spring 66 and to retain the hook 74 in a desired position of adjustment. The first link member 56 is secured in a desired position of adjustment about the pivot arm 54 by means of a set screw 80 or the like. Finally, a block 81 is mounted on the base 12 adjacent the forward end 42 thereof and an arm 83 is pivotally mounted thereon with a screw 85 threadedly carried adjacent the rear end 87 of arm 83 and clamping means 89 is provided adjacent the opposite end of arm 83 to clamp the bass drum pedal 10 to the rim of a bass drum, not shown.

In another aspect and as an alternative to the first and second link members (depicted as elements 56 and 60 in FIG. 7), the present invention also includes a variable pivot point spring rotor as depicted in FIGS. 8A through 14. The variable pivot point spring rotor increases the rate at which the spring is engaged, which affects the return action of the beater.

Figure 8A:
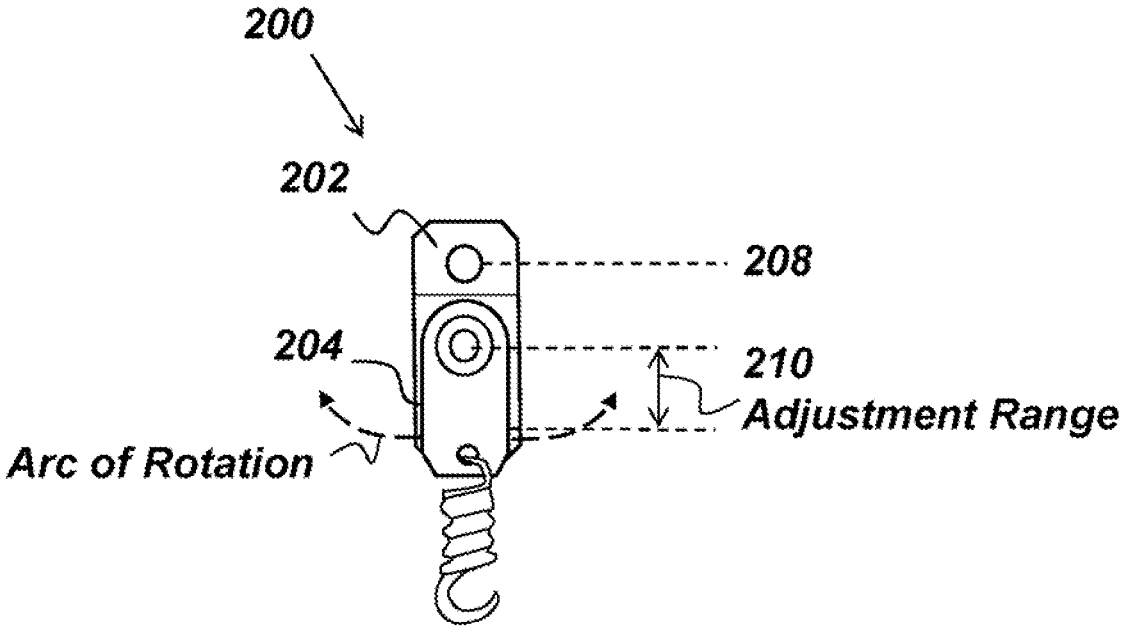
FIG. 8A is an illustration of a variable pivot point spring rotor according to the present invention, depicting its rocker and swivel components.
Figure 8B:
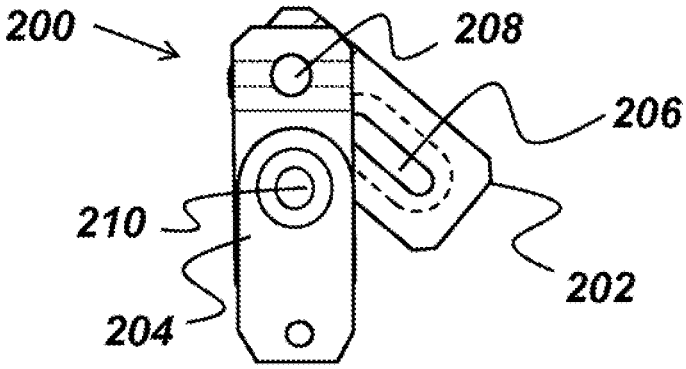
FIG. 8B is an illustration of the variable pivot point spring rotor according to the present invention.

As shown in FIGS. 8A and 8B, the variable pivot point spring rotor 200 includes a rocker component 202 and a swivel component 204, which can be used in place of the first link and second link (depicted as elements 56 and 60 in FIG. 7), respectively. As shown in FIG. 8B, the rocker component 202 includes a slot 206 formed therethrough that allows the swivel component 204 to be attached at varying locations along the rocker component 202. Importantly and as depicted in both FIGS. 8A and 8B, by altering the location of attachment, a user can effectively alter the distance between the rocker axis of rotation 208 and the swivel axis of rotation 210.

Figure 9A:
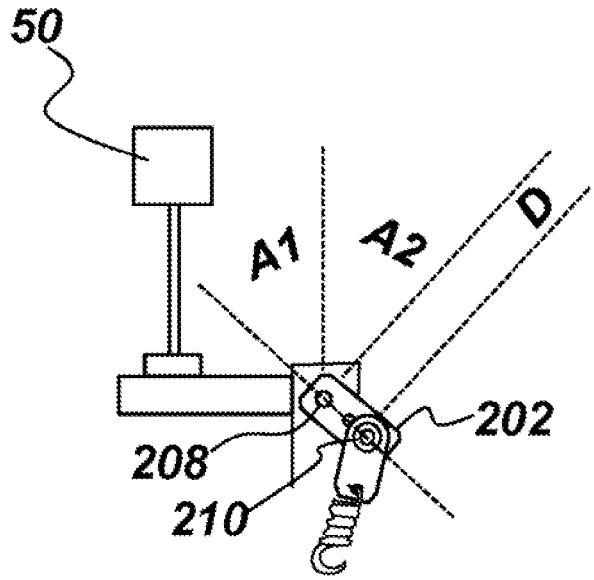
FIG. 9A is an illustration of the variable pivot point spring rotor according to the present invention.
Figure 9B:
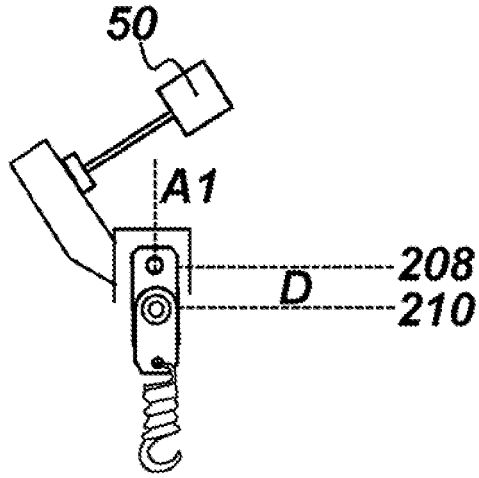
FIG. 9B is an illustration of the variable pivot point spring rotor according to the present invention.

FIGS. 9A and 9B depict various angles that are provided by the rocker component. For example, A1 is the angle of the rocker component 202 as the beater 50 hits a drumhead. D is the distance between the rocker axis of rotation 208 and the swivel axis of rotation 210. Further, A2 is an angle that is equal to A1 when the beater 50 is in full reverse position (not depicted).

Alternatively and as depicted in FIG. 9B, A1 is zero when the beater 50 is at rest. Again, D is the distance between the rocker axis of rotation 208 and the swivel axis of rotation 210.

Figure 10:
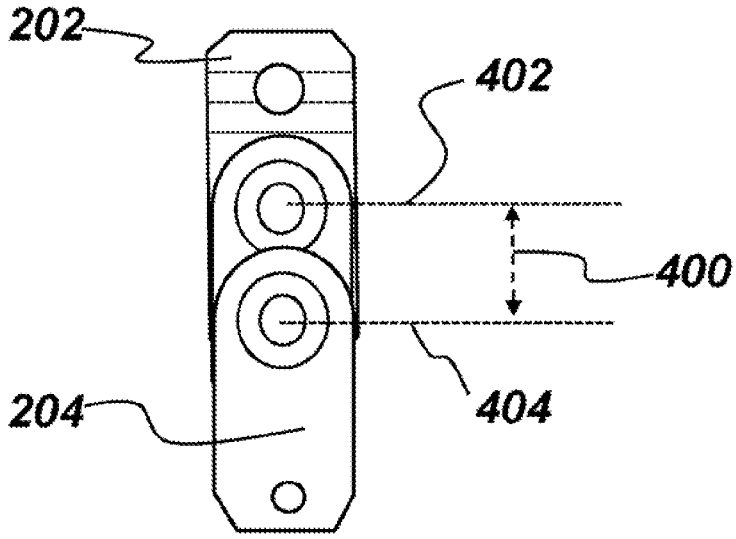
FIG. 10 is an illustration of the variable pivot point spring rotor according to the present invention.

FIG. 10 is an illustration depicting that the swivel component 204 can be set at any position in the slide range 400 of the rocker component 202. The figure illustrates the swivel component 204 being set in the top position 402 and, alternatively, the bottom (lowest) position 404.

Figure 11:
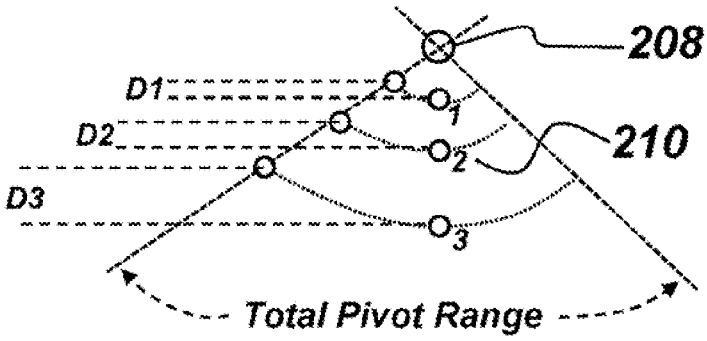
FIG. 11 is an illustration depicting a pivot range of the variable pivot point spring rotor.

FIG. 11 is an illustration depicting how the pivot range is impacted by altering the distances between the rocker axis of rotation 208 and the swivel axis of rotation 210 (illustrated in positions 1, 2, and 3). As the swivel component is moved down the rocker component and the distance between the rocker axis of rotation 208 and swivel axis of rotation 210 increases, the amount of overall spring deflection (i.e., D1, D2, and D3) also increase.

Figure 12A:
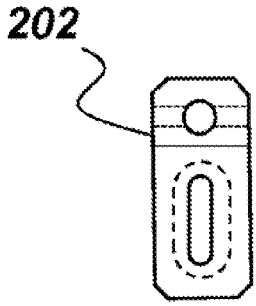
FIG. 12A is a front-view illustration of the rocker component.
Figure 12B:
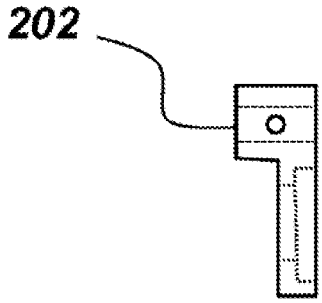
FIG. 12B is a right, side-view illustration of the rocker component.
Figure 13A:
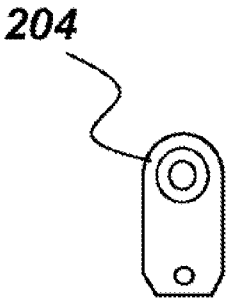
FIG. 13A is a front-view illustration of the swivel component.
Figure 13B:
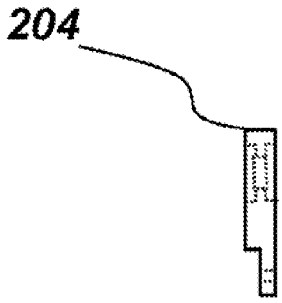
FIG. 13B is a right, side-view illustration of the swivel component.

For further understanding, FIG. 12A is a front-view illustration of the rocker component 202, while FIG. 12B is a right, side-view illustration of the rocker component 202. Alternatively, FIG. 13A is a front-view illustration of the swivel component 204 while FIG. 13B is a right, side-view illustration of the swivel component 204.

Figure 14:
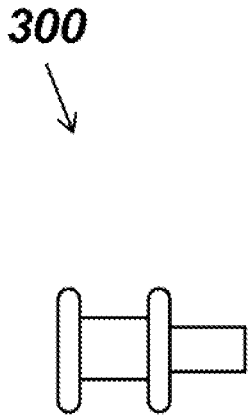
FIG. 14 is an illustration of a swivel axle.

The swivel component is attached with rocker component with a swivel axle. As shown in FIG. 14, the swivel axle 300 allows the swivel component to rotate about the swivel axle while the swivel axle remains fixedly attached with the rocker component. In other words, the swivel axle 300 can be selectively and fixedly attached (e.g., using a clamp means) anywhere along the slot of the rocker component, thereby fixing the distance between the rocker axis of rotation and the swivel axis of rotation. Further, ball bearings or any other suitable rotatable means can be used to assist the swivel component with freely rotating about the swivel axle 300.

As can be appreciated, numerous variations and modifications can be made without departing from the spirit of the present invention. Therefore, it should be clearly understood that the forms of the present invention described above and shown in the figures of the accompanying drawings are illustrative only and are not intended to limit the scope of the present invention.

What is claimed is:

1. A bass drum pedal comprising:

a base;

a foot pedal having one end pivotally secured to a front end of said base;

a column connected to said base adjacent to the opposite end of said base from said front end and extending longitudinally above said base;

a beater bracket pivotally mounted to said column and adjacent to the upper end of said column, the beater bracket including:

a pivot end having a pivotal attachment means;

an outer end, with a long axis passing between the pivot end and the outer end;

a mounting surface, the mounting surface formed such that a mounting surface angle exists between the long axis and the mounting surface;

an attachment means formed on the mounting surface to attach with a shaft of a beater, such that when a shaft of a beater is attached with the mounting surface, the shaft is tipped forward to form a forward beater angle;

linkage means for linking said foot pedal to said beater bracket to actuate said beater bracket in response to a force applied to said foot pedal and adjustably coupled therebetween to permit selective positioning along said beater bracket;

bias means for biasing said beater bracket to said column and adjustably coupled therebetween to permit selective control of the force required for said foot pedal to move said beater bracket; and a beater having a shaft releasably secured in said beater bracket for striking a bass drum in response to said beater bracket being moved by said foot pedal.

2. The bass drum pedal of claim 1, wherein the mounting surface angle is between ten and forty degrees.

3. The bass drum pedal of claim 2, wherein the mounting surface angle is between nineteen and twenty three degrees.

4. The bass drum pedal of claim 3, wherein the mounting surface angle is approximately twenty one degrees.

5. The bass drum pedal of claim 4, wherein the attachment means is a shaft bore that extends through the beater bracket adjacent the outer end to releasably receive the shaft of a beater.

6. The bass drum pedal of claim 1, wherein the attachment means is a shaft bore that extends through the beater bracket adjacent the outer end to releasably receive the shaft of a beater.

* * * * *